US010652985B1

(12) United States Patent
Movahed

(10) Patent No.: US 10,652,985 B1
(45) Date of Patent: May 12, 2020

(54) MULTIPROTOCOL LIGHTING CONTROL

(71) Applicant: Eaton Intelligent Power Limited, Dublin (IE)

(72) Inventor: Kayvon Movahed, Decatur, GA (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 16/386,053

(22) Filed: Apr. 16, 2019

(51) Int. Cl.
*H05B 47/10* (2020.01)

(52) U.S. Cl.
CPC ..... *H05B 47/10* (2020.01)

(58) Field of Classification Search
None
See application file for complete search history.

(56) References Cited

U.S. PATENT DOCUMENTS

| | | | |
|---|---|---|---|
| 6,388,399 | B1 | 5/2002 | Eckel |
| 7,123,140 | B1 | 10/2006 | Denes |
| 8,222,832 | B2 | 7/2012 | Zheng |
| 8,415,901 | B2 | 4/2013 | Recker |
| 8,492,984 | B2 | 7/2013 | Deurenberg |
| 8,643,304 | B2 | 2/2014 | Hamel |
| 8,941,304 | B2 | 1/2015 | Goscha |
| 9,992,389 | B1 | 6/2018 | Fu |
| 10,190,761 | B1 | 1/2019 | Winters |
| 2003/0209999 | A1 | 11/2003 | Hui |
| 2003/0222588 | A1 | 12/2003 | Myron |
| 2006/0044152 | A1 | 3/2006 | Wang |
| 2006/0244622 | A1 | 11/2006 | Wray |
| 2007/0247086 | A1 | 10/2007 | Chiu |
| 2007/0291483 | A1 | 12/2007 | Lys |
| 2008/0232116 | A1 | 9/2008 | Kim |
| 2010/0118148 | A1 | 5/2010 | Lee |
| 2010/0164386 | A1 | 7/2010 | You |
| 2010/0204847 | A1 | 8/2010 | Leete |
| 2010/0301781 | A1 | 12/2010 | Budike |
| 2011/0006658 | A1 | 1/2011 | Chan |
| 2011/0184577 | A1 | 7/2011 | Ilyes |
| 2011/0204820 | A1 | 8/2011 | Tikkanen et al. |
| 2011/0234104 | A1 | 9/2011 | Mishima |
| 2012/0112654 | A1 | 5/2012 | Choong |
| 2012/0139426 | A1 | 6/2012 | Ilyes |
| 2012/0181935 | A1 | 7/2012 | Velazquez |
| 2012/0188754 | A1 | 7/2012 | Fitzwater, II |
| 2012/0206050 | A1 | 8/2012 | Spero |
| 2013/0049633 | A1 | 2/2013 | Wann |
| 2013/0076270 | A1 | 3/2013 | Alexandrovich |
| 2013/0094207 | A1 | 4/2013 | Negandhi |

(Continued)

OTHER PUBLICATIONS

Office Action for U.S. Appl. No. 15/784,977 dated Nov. 28, 2018.

(Continued)

*Primary Examiner* — Jany Richardson
(74) *Attorney, Agent, or Firm* — King & Spalding LLP

(57) ABSTRACT

A method of controlling different types of lighting fixture drivers includes sending, by a lighting control device, one or more queries to a driver. The method further includes determining, by the lighting control device, a type of the driver based on one or more results of the one or more queries. The method also includes sending to the driver, by the lighting control device, a lighting control command that is compatible with the driver after determining the type of the driver.

18 Claims, 5 Drawing Sheets

(56) References Cited

U.S. PATENT DOCUMENTS

| | | | |
|---|---|---|---|
| 2013/0187552 | A1 | 7/2013 | Frodsham |
| 2013/0257284 | A1 | 10/2013 | Vanwaooner |
| 2013/0271004 | A1 | 10/2013 | Min |
| 2013/0342131 | A1 | 12/2013 | Recker |
| 2014/0001952 | A1 | 1/2014 | Harris |
| 2014/0001962 | A1 | 1/2014 | Harris |
| 2014/0028200 | A1 | 1/2014 | Van Wagoner et al. |
| 2014/0049972 | A1 | 2/2014 | McGuire |
| 2014/0062334 | A1 | 3/2014 | Nagazoe |
| 2014/0062693 | A1 | 3/2014 | Watts |
| 2014/0070707 | A1 | 3/2014 | Nagazoe |
| 2014/0254199 | A1 | 9/2014 | Athalye |
| 2014/0265880 | A1 | 9/2014 | Taipale |
| 2014/0268722 | A1 | 9/2014 | Holland |
| 2014/0268733 | A1 | 9/2014 | Holland |
| 2014/0300293 | A1 | 10/2014 | Ruan |
| 2015/0008845 | A1 | 1/2015 | Kim |
| 2015/0015152 | A1 | 1/2015 | Aboulnaga |
| 2015/0048762 | A1 | 2/2015 | Yang |
| 2015/0198324 | A1 | 7/2015 | O'Brien |
| 2016/0014867 | A1 | 1/2016 | Luk |
| 2016/0057837 | A1 | 2/2016 | Brand |
| 2016/0128140 | A1 | 5/2016 | Quilici |
| 2016/0128158 | A1 | 5/2016 | Harder |
| 2016/0165659 | A1 | 6/2016 | Deng |
| 2016/0255697 | A1 | 9/2016 | Bhide |
| 2016/0255704 | A1 | 9/2016 | Mueller |
| 2016/0273717 | A1 | 9/2016 | Krames |
| 2016/0330825 | A1 | 11/2016 | Recker |
| 2016/0370535 | A1 | 12/2016 | Boomgaarden |
| 2017/0093210 | A1 | 3/2017 | Recker |
| 2017/0105272 | A1 | 4/2017 | Johnson |
| 2017/0139108 | A1 | 5/2017 | Boomgaarden |
| 2017/0223807 | A1 | 8/2017 | Recker |
| 2017/0265286 | A1 | 9/2017 | Song |
| 2017/0307143 | A1 | 10/2017 | Shah |
| 2018/0042089 | A1* | 2/2018 | Cho ..... H05B 37/0272 |
| 2018/0049300 | A1 | 2/2018 | Recker |
| 2018/0073686 | A1 | 3/2018 | Quilici |
| 2018/0084627 | A1 | 3/2018 | Recker |

OTHER PUBLICATIONS

International Search Report for application No. PCT/US2016/024006 dated Jun. 30, 2016.

Casambi CBU-TED, Fact sheet, Mar. 7, 2015.

* cited by examiner

MULTIPROTOCOL LIGHTING CONTROL

TECHNICAL FIELD

The present disclosure relates generally to lighting solutions, and more particularly to lighting control for lighting fixtures with multiple types of drivers.

BACKGROUND

Lighting systems may include different lighting control devices such as switches, dimmers, sensors, etc. In general, a lighting control device supports a single type of lighting driver, such as an LED driver, or a single type of ballast of a lighting fixture. In general, multiple lighting control devices that support different types of drivers/ballasts are required to support different drivers/ballasts that are used in a lighting system. A manufacturer of lighting control devices also has to design and manufacture multiple types of lighting control devices to support different types of drivers/ballasts. The need to have one-to-one dedicated compatibility between lighting control devices and drivers/ballasts may result in complications and errors during installation. For manufacturers of lighting control devices, the manufacturing of different lighting control devices for compatibility with different types of drivers/ballasts imposes manufacturing challenges. Thus, a solution that reduces the challenges associated with the use of different types of lighting control devices with different types of drivers/ballasts may be desirable.

SUMMARY

The present disclosure relates generally to lighting solutions, and more particularly to lighting control for lighting fixtures with multiple types of drivers. In some example embodiments, a method of controlling different types of lighting fixture drivers includes sending, by a lighting control device, one or more queries to a driver. The method further includes determining, by the lighting control device, a type of the driver based on one or more results of the one or more queries. The method also includes sending to the driver, by the lighting control device, a lighting control command that is compatible with the driver after determining the type of the driver.

In another example embodiment, a lighting control device includes a driver interface circuit configured to provide a driver control signal to a driver. The lighting control device further includes a controller configured to send one or more queries to the driver via the driver interface circuit, determine a type of the driver based on one or more results of the one or more queries, and send a lighting control command to the driver via the driver interface circuit. The driver interface circuit is configured to generate the driver control signal based on the lighting control command, and the driver control signal is compatible with the type of the driver.

In another example embodiment, a lighting system includes a lighting fixture that includes a light source and a driver that provides power to the light source. The lighting system further includes a lighting control device that includes a controller configured to send one or more queries to the driver, determine a type of the driver based on one or more results of the one or more queries, and send a driver control signal to the driver, wherein the driver control signal is compatible with the type of the driver.

These and other aspects, objects, features, and embodiments will be apparent from the following description and the appended claims.

BRIEF DESCRIPTION OF THE FIGURES

Reference will now be made to the accompanying drawings, which are not necessarily drawn to scale, and wherein.

Figure 1:
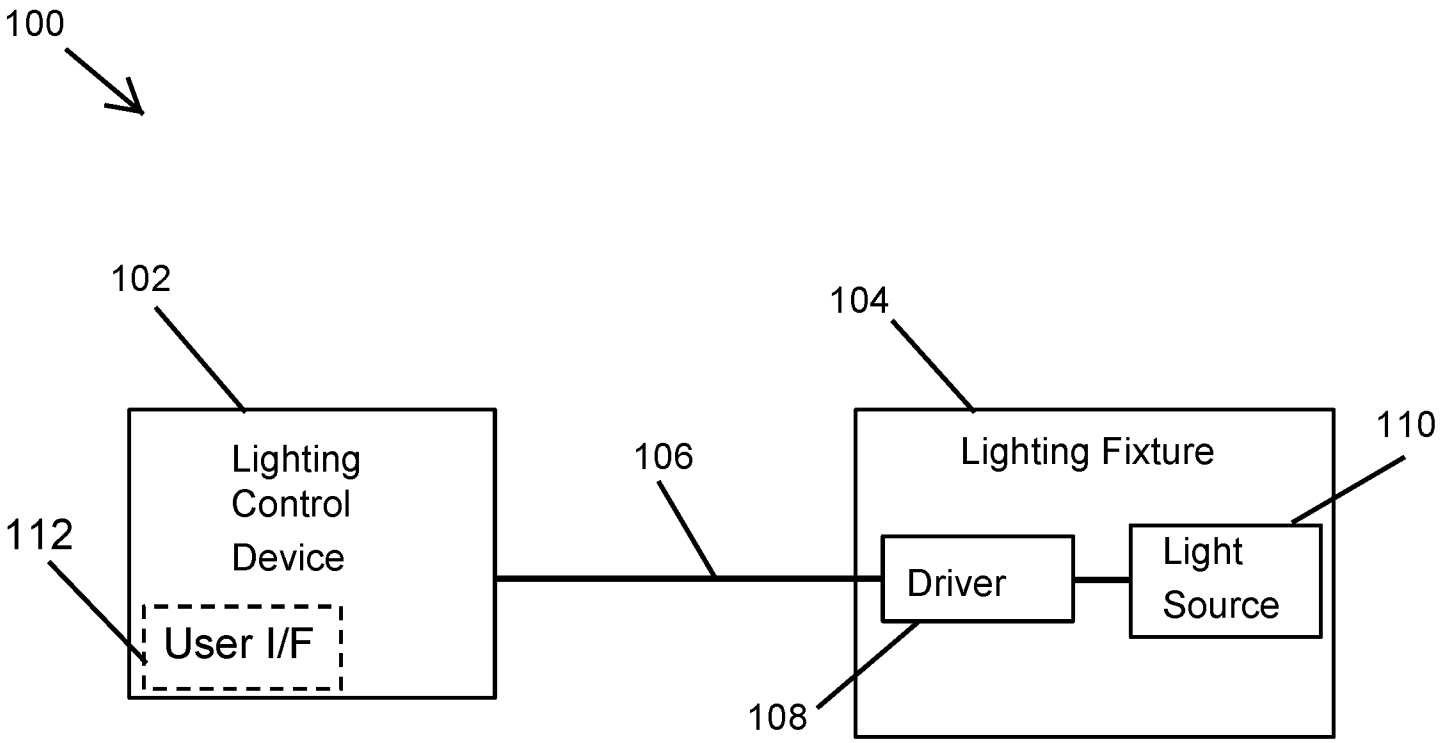
FIG. 1 illustrates a lighting system including a multi-protocol lighting control device according to an example embodiment.

The drawings illustrate only example embodiments and are therefore not to be considered limiting in scope. The elements and features shown in the drawings are not necessarily to scale, emphasis instead being placed upon clearly illustrating the principles of the example embodiments. Additionally, certain dimensions or placements may be exaggerated to help visually convey such principles. In the drawings, the same reference numerals used in multiple drawings designate like or corresponding but not necessarily identical elements.

DETAILED DESCRIPTION OF THE EXAMPLE EMBODIMENTS

In the following paragraphs, example embodiments will be described in further detail with reference to the figures. In the description, well known components, methods, and/or processing techniques are omitted or briefly described. Furthermore, reference to various feature(s) of the embodiments is not to suggest that all embodiments must include the referenced feature(s).

Turning now to the figures, particular embodiments are described. FIG. 1 illustrates a lighting system 100 including a multi-protocol lighting control device 102 according to an example embodiment. In some example embodiments, the lighting system 100 includes the lighting control device 102 and a lighting fixture 104. The lighting control device 102 may communicate with or provide control signals to the lighting fixture 104 via a wired connection 106. For example, the wired connection 106 may include one or more electrical wires, traces, etc.

In some example embodiments, the lighting control device 102 may be or may include a power switch, a dimmer 102, a wall station, a sensor (e.g., one or more of a motion sensor, a light sensor, etc.), and/or another lighting related device. To illustrate, the lighting control device 102 may control some operations of the lighting fixture 104. For example, the lighting control device 102 may control whether the lighting fixture 104 is powered on or off. As another example, the lighting control device 102 may control the dim level of the light provided by the lighting fixture 104. As yet another example, the lighting control device 102 may also control the color temperature of the light provided by the lighting fixture 104. For example, the lighting control device 102 may include one or more of a motion sensor, a light sensor, etc.

In some example embodiments, the lighting control device 102 may include a user interface 112. To illustrate, the user interface 112 may be an input interface and/or an output interface. For example, the user interface 112 may include a knob or a slider, for example, for adjusting the dim level of the light provided by the lighting fixture 104. Another example, the user interface 112 may include one or more buttons that a user can press to provide an input such as light on or off, a dim level selection, a color temperature selection, etc.

In some example embodiments, the user interface 112 may include an output interface such as one or more indicator light sources that emit one or more lights to indicate information such as status information, operation mode, type of driver of the lighting fixture 104, etc. Alternatively or in addition, the user interface 112 may include a display screen for displaying information and/or for receiving user input. In some example embodiments, the user interface may be omitted without departing from the scope of this disclosure.

In some example embodiments, the lighting fixture 104 may include a driver 108 and a light source 110 that emits, for example, an illumination light. The driver 108 may be a Sensor Ready driver, a Digital Addressable Lighting Interface (DALI) driver, or a 0-10v driver. The light source 110 may include one or more discrete light emitting diodes (LEDs), one or more organic light-emitting diodes (OLEDs), an LED chip on board that includes one or more discrete LEDs, an array of discrete LEDs, or light source(s) other than LEDs. The driver 108 may provide power to the light source 110, where the illumination light provided by the light source 110 depends on the power provided by the driver 108.

In some example embodiments, the lighting control device 102 may determine the type of the driver 108 before controlling the driver 108 to control the light provided by the light source 110. For example, the lighting control device 102 may be able to control a Sensor Ready (SR) driver, a DALI driver, and a 0-10v driver. To illustrate, the lighting control device 102 may determine whether the driver 108 is a Sensor Ready driver, a DALI driver, or a 0-10v driver to generate control signals that are compatible with the driver 108 and to receive information, if applicable, from the driver 108 via the connection 106. The lighting control device 102 may provide one or more digital signals to the driver 108 to control the driver 108 if the lighting control device 102 determines that the driver 108 is a Sensor Ready driver or a DALI driver. The lighting control device 102 may provide one or more analog signals (e.g., an analog signal between 0 volt and 10 volts) to the driver 108 to control the driver 108 if the lighting control device 102 determines that the driver 108 is 0-10v driver.

In some example embodiments, the lighting control device 102 may send one or more queries to the driver 108 and determine the type of the driver 108 based on the result of the queries. For example, the one or more queries may be register read commands. To illustrate, not knowing the type of the driver 108 yet, the lighting control device 102 may send, via the connection 106, one or more read commands to the driver 108 to read one or more register banks that an SR driver and a DALI driver are expected to have. For example, SR drivers and DALI drivers may have one or more register banks that include information (e.g., manufacturer, whether SR or DALI, etc.) indicative of the type of driver. These register banks may be at industry standard addresses or otherwise known addresses such that a user may access the register banks without prior knowledge of the type of the driver 108. For example, a first register bank of SR drivers and DALI drivers (e.g., a register bank at address 0) may include information indicative of the manufacturer of the driver, and a second register bank of SR drivers (e.g., a register bank at address 11 of SR drivers) may include information indicative of whether the driver is an SR driver.

During operation, after sending a register read command to the driver 108 to read a first register bank (e.g., a register bank indicating the driver manufacturer), the lighting control device 102 may receive a result of the register read command from the driver 108 via the connection 106. If the driver manufacturer indicated by the result is an SR driver manufacturer, the lighting control device 102 may send a register read command to the driver 108 to read a second register bank that indicates whether the driver 108 is an SR driver. If the result of the second register read command indicates that the driver 108 is an SR driver (e.g., a digital "1" value), the lighting control device 102 may determine that the driver 108 is an SR driver. If the result of the second register read command indicates that the driver 108 is not an SR driver (e.g., a digital "0" value), the lighting control device 102 may determine that the driver 108 is a DALI driver because the driver 108 is either an SR driver, a DALI driver, or a 0-10v driver. Because a 0-10v driver is not expected to provide a response to register read commands, the lighting control device 102 may determine that the driver 108 is a 0-10v driver if one or more register read commands do not produce results expected from an SR driver or a DALI driver.

In some example embodiments, to increase the reliability of the results of the register read commands, the lighting control device 102 may send the register read commands to the driver 108 multiple times (e.g., 3 times). For example, the lighting control device 102 may determine that the driver 108 is a particular type of driver if the majority of the results indicate that the driver 108 is the particular type of the driver.

In some example embodiments, after determining the type of the driver 108, the lighting control device 102 may send light control commands to the driver 108 that are compatible with the driver 108. For example, the lighting control device 102 may send lighting control commands that are compatible with the SR driver protocol (i.e., compatible with SR drivers) to the driver 108 if the lighting control device 102 determines that the driver 108 is an SR driver. The lighting control device 102 may send lighting control commands that are compatible with the DALI driver protocol (i.e., compatible with DALI drivers) to the driver 108 if the lighting control device 102 determines that the driver 108 is a DALI driver. The lighting control device 102 may send lighting control commands that are compatible with the 0-10v driver protocol (i.e., compatible with 0-10v drivers) to the driver 108 if the lighting control device 102 determines that the driver 108 is a 0-10v driver.

By determining the type of the driver 108 and by sending compatible lighting control commands to the driver 108, the lighting control device 102 can reduce the need for lighting control devices that are dedicated to a particular type of driver. The use of the lighting control device 102 also avoids the need for lighting control devices that have multiple interfaces that are dedicated to different types of drivers. The use of the lighting control device 102 also reduces installation errors by determining the type of the driver 108, which reduces the reliance on an installer to correctly match lighting control devices with lighting fixtures.

In some alternative embodiments, the lighting fixture 104 may include a ballast instead of the driver 108 without departing from the scope of this disclosure. For example, the light source 110 may be a non-LED light source such as a fluorescent light source. In some alternative embodiments, the driver 108 may be external to the lighting fixture 104. In some alternative embodiments, the driver 108 may provide power to light sources of different lighting fixtures without departing from the scope of this disclosure. In some example embodiments, the lighting control device 102 may include a wired or wireless communication module for communicating with a remote device (e.g., a mobile device). For example, the lighting control device 102 may receive user input wirelessly and may wirelessly transmit information such as status information, the type of the driver 108, etc. to a user device. In some alternative embodiments, the lighting system 100 may include other lighting control devices that control and/or communicate with the lighting fixture 102 or other lighting fixtures of the lighting system 100 in a similar manner as the lighting control device 102.

Figure 2:
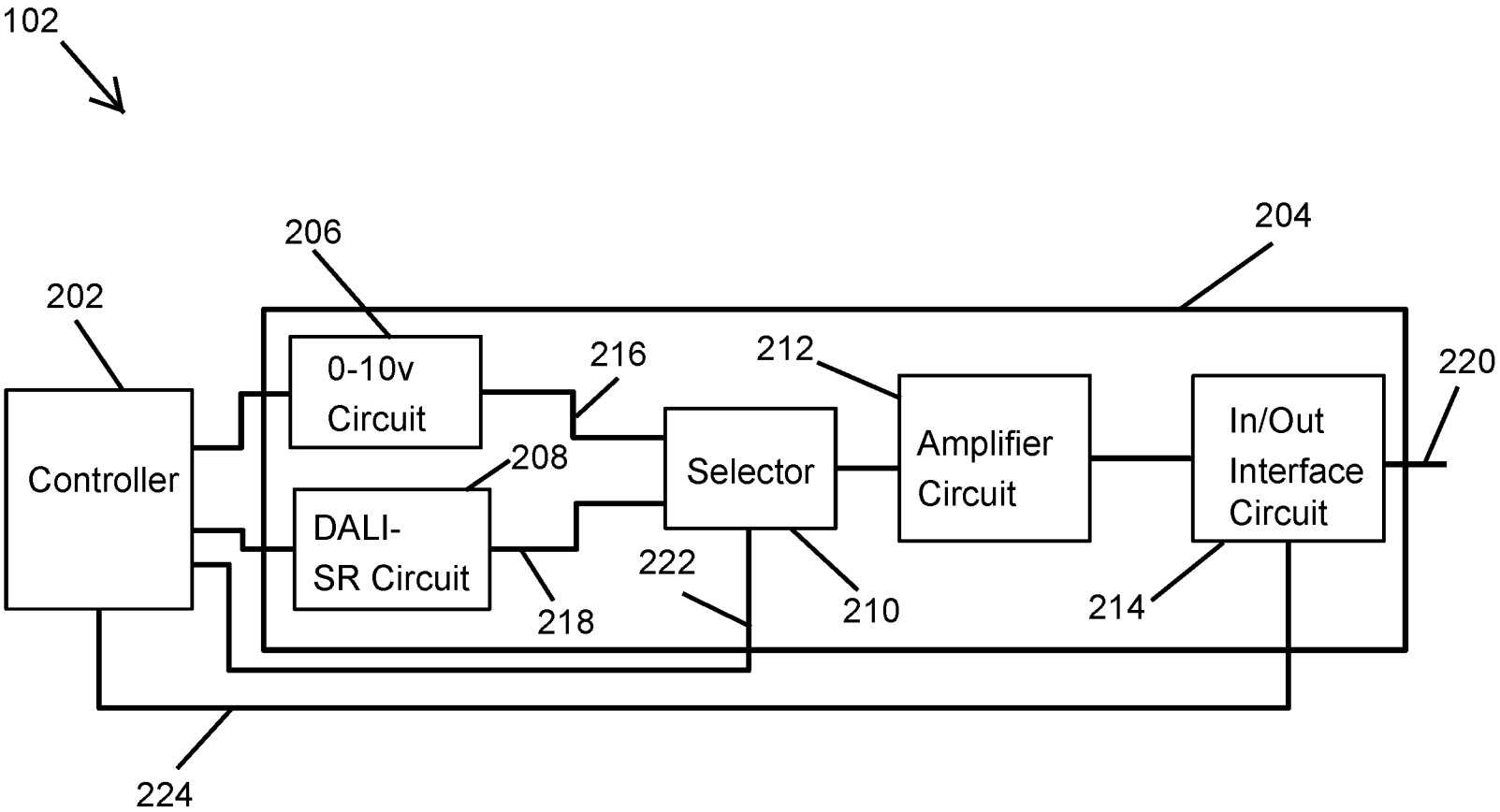
FIG. 2 illustrates a block diagram of the lighting control device of FIG. 1 according to an example embodiment.

FIG. 2 illustrates a block diagram of the lighting control device 102 of FIG. 1 according to an example embodiment. Referring to FIGS. 1 and 2, in some example embodiments, the lighting control device 102 may include a controller 202 and a driver interface circuit 204. The controller 202 may control the operation of the lighting control device 102. For example, the controller 202 may include a microcontroller or a microprocessor and supporting components such as memory devices, etc. and may execute software code to perform some of the operations of the lighting control device 102.

In some example embodiments, the driver interface circuit 204 may include a 0-10v circuit, a DALI-SR circuit 208, a selector circuit 210, an amplifier circuit 212, and an input/output interface circuit 214. The controller 202 may control the driver interface circuit 204 to output a driver control signal on a port 220. The driver control signal may be provided to the driver 108 of the lighting fixture 104 via the connection 106 as shown in FIG. 1. The controller 202 may also receive a driver signal from the driver 108 via the port 220.

In some example embodiments, the 0-10v circuit may receive a pulse width modulation (PWM) signal from the controller 202 and may generate an output signal that may be provided to the selector circuit 210 via an electrical connection 216 (e.g., one or more electrical wires). For example, the 0-10v circuit may include a low pass filter that receives and filters the PWM signal to generate the output signal. Alternatively, the 0-10v circuit may include a digital-to-analog converter that receives on or more digital signals from the controller 202 and generates the output analog signal that is provided to the selector circuit 210.

In some example embodiments, the DALI-SR circuit 208 may receive a digital signal from the controller and may output an output signal on an electrical connection 216 (e.g., one or more electrical wires) that is provided to the selector circuit 210. For example, the output signal generated by the DALI-SR circuit 208 may be reflect the binary state of the digital signal from the controller 202 at different voltage levels.

In some example embodiments, the selector circuit 210 may receive a select signal from the controller 202 via an electrical connection 222 and may provide either the output signal from the 0-10v circuit 206 or the output signal from the DALI-SR circuit 208 to the amplifier circuit 212. To illustrate, the selector circuit 210 may select either the output signal from the 0-10v circuit 206 or the output signal from the DALI-SR circuit 208 based on the select signal from the controller 202. The amplifier circuit 212 may receive the output signal from the selector circuit 210 and may amplify the signal to generate an amplified signal that is provided to the input/output interface circuit 214. For example, the input/output interface circuit 214 may perform voltage level adjustment of the amplified signal from the amplifier circuit 212 before providing a voltage adjusted output signal on the port 220.

In some example embodiments, the input/output interface circuit 214 may receive an input signal, for example, from the driver 108 via the connection 106 and the port 220. The input/output interface circuit 214 may adjust the voltage level of the input signal, for example to digital voltage levels and provide the adjusted signal to the controller 202 via a connection 224 (e.g., one or more electrical wires).

In some example embodiments, the controller 202 may send register read commands to the driver 108 via the DALI-SR circuit 208 by selecting the output of the DALI-SR circuit 208 using the select signal provided to the selector circuit 210. To illustrate, the driver interface circuit 204 may generate the driver control signal from one or more register read commands provided by the controller 202 to the DALI-SR circuit 208. The driver control signal generated from the one or more register read commands is provided to the driver 108 via the port 220 and the connection 106. The results of the register read commands may be received by the driver interface circuit 204 from the driver 108 via the port 220 if the driver 108 is an SR driver or a DALI driver.

If the controller 202 determines that the driver 108 is an SR driver or a DALI driver, the controller 202 may send SR lighting control commands or DALI lighting control commands to the driver 108 via the DALI-SR circuit 208 by providing the SR or DALI command the DALI-SR circuit 208 and by selecting the output of the DALI-SR circuit 208 using the select signal provided to the selector circuit 210. The controller 202 may also receive, via the port 220 and the driver interface circuit 204, signals resulting from lighting control commands sent to the driver 108 via the driver interface circuit 204.

If the controller 202 determines that the driver 108 is a 0-10 driver, the controller 202 may send 0-10v lighting control commands to the driver 108 via the 0-10v circuit 206 by providing the 0-10v command from the 0-10v circuit 206 and by selecting the output of the 0-10v circuit 206 using the select signal provided to the selector circuit 210.

In some alternative embodiments, the lighting control device 102 may include components other than shown in FIG. 2 without departing from the scope of this disclosure. In some alternative embodiments, the components of the lighting control device 102 may be coupled in a different configuration than shown without departing from the scope of this disclosure. In some alternative embodiments, some of the components of the lighting control device 102 may be integrated into a single component. In some example embodiments, the user interface 112 shown in FIG. 1 may be coupled to the controller 202.

Figure 3:
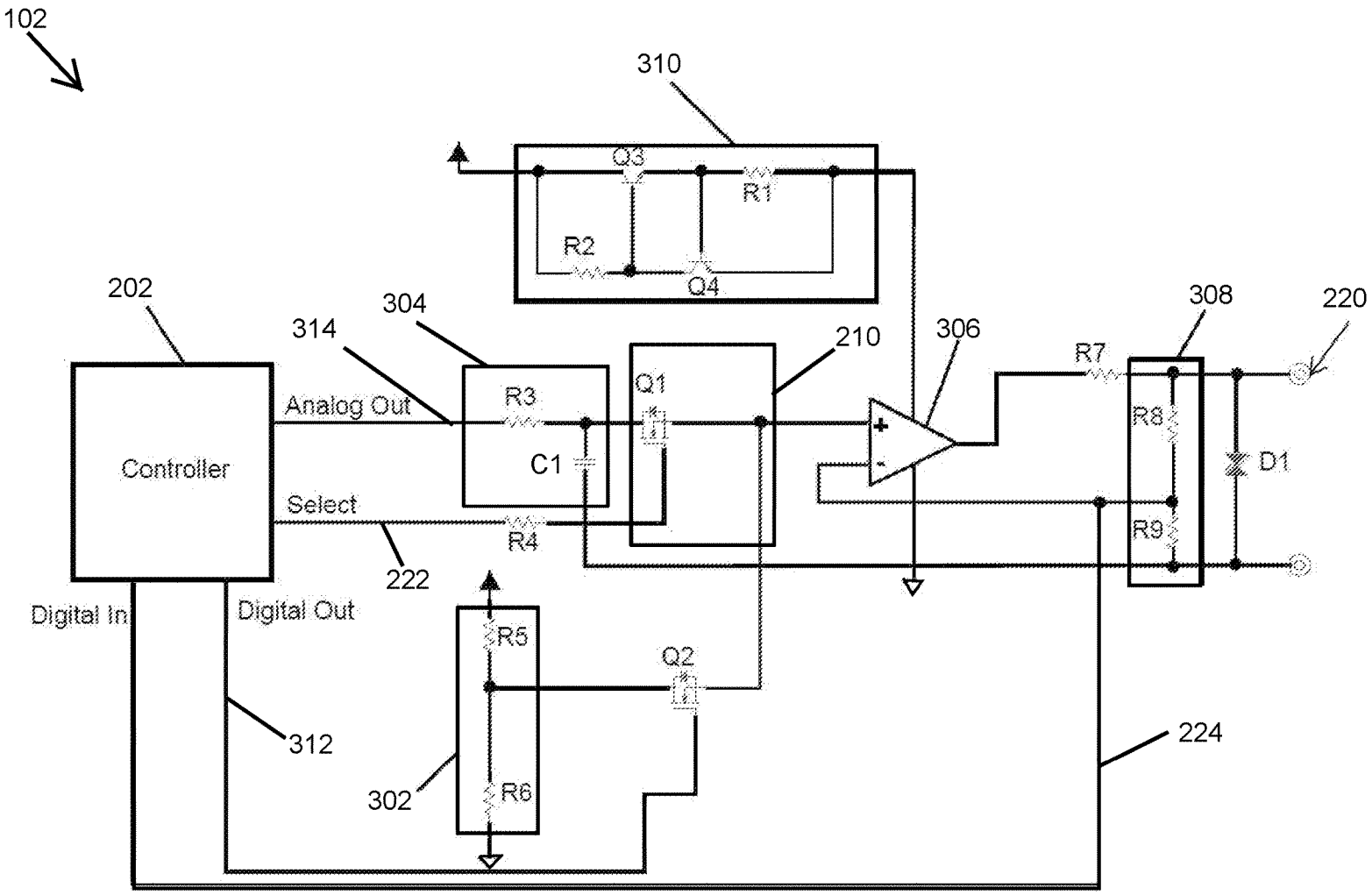
FIG. 3 illustrates a schematic diagram of the lighting control device of FIG. 1 according to an example embodiment.

FIG. 3 illustrates a schematic diagram of the lighting control device 102 of FIG. 1 according to an example embodiment. Referring to FIGS. 1-3, in some example embodiments, lighting control device 102 may include the controller 202, a voltage divider circuit 302 that includes resistors R5 and R6, and a low pass filter 304 that includes a resistor R3 and a capacitor C1. For example, the low pass filter 304 may correspond to 0-10v circuit 206 shown in FIG. 2. The controller 202 may provide the "analog out" signal to the low pass filter 304 via an electrical connection 314. For example, the "analog out" signal may be a PWM signal that is intended to be ultimately provided to the driver 108 as a 0-10v lighting control signal.

In some example embodiments, the voltage divider circuit 302 and a transistor Q2 may together correspond to the DALI-SR circuit 208 shown in FIG. 2. For example, the controller 202 may provide register read commands, lighting control commands, etc. to the transistor Q2 as a "digital out" signal.

In some example embodiments, the lighting control device 102 also includes that the selector circuit 210 that may include a transistor Q1. The transistor Q1 is controlled by the select signal from the controller 202. The voltage adjusted signal from the transistor Q2 and the filtered signal from the low pass filter 304 are provided to the selector circuit 210. The controller 202 may turn off the transistor Q2, and if the controller 202 selects the "analog out" signal, the transistor Q1 may pass the filtered signal from the low pass filter 304 to an operational amplifier (opamp) 306. The transistor Q1 may block the the filtered signal from the low pass filter 304 if the controller 202 selects the "digital out" signal, and the transistor Q2 may pass the voltage-adjusted "digital out" signal to the opamp 306.

The opamp 306 may amplify the signal received from the selector circuit 210 and may generate an amplified signal to be provided to the port 220 via a resistor R7. A diode D1 may serve to limit the voltage level at the port 220. The voltage divider circuit 308 can serve to limit the amplification by the amplifier 306, and the current limiting circuit 310 can serve to limit the current output of the amplifier 306. The transistors Q3 and Q4 and resistors R1 and R2 function to limit the maximum current provided by the opamp 306. For example, the amplifier 306 and the current limiting circuit 310 may together correspond to the amplifier circuit 212 shown in FIG. 2, and the voltage divider circuit 308 and the diode D1 may together correspond to the input/output interface circuit 214 shown in FIG. 2.

In some example embodiments, the voltage divider circuit 308, which includes the resistors R8 and R9, serves to limit the voltage level of the "digital in" signal provided to the controller 202. For example, the digital in" signal may be generated from a signal sent by the driver 108 via the port 220 as a result of a register read command or a lighting control command sent to the driver 108 shown in FIG. 1. The resistance values of the resistors R8 and R9 as well as the values/specifications of other resistors, capacitors, transistors, diode, etc. may be selected based on relevant voltage levels as can be readily understood by those of ordinary skill in the art with the benefit of this disclosure.

In some example embodiments, the lighting control device 102 may include other components without departing from the scope of this disclosure. In some alternative embodiments, the components of the lighting control device 102 may be coupled in a different configuration than shown without departing from the scope of this disclosure. In some alternative embodiments, some of the components of the lighting control device 102 may be integrated into a single component. In some alternative embodiments, the lighting control device 102 may be implemented using more, fewer, and/or some different components than shown without departing from the scope of this disclosure. In some example embodiments, the user interface 112 shown in FIG. 1 may be coupled to the controller 202.

Figure 4:
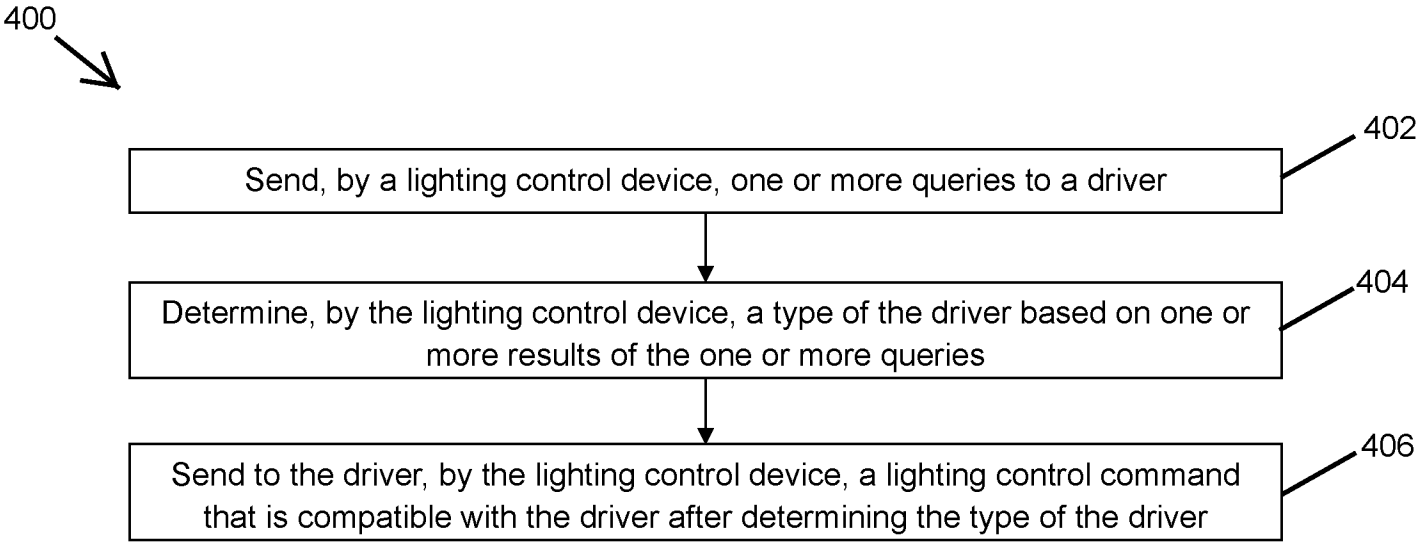
FIG. 4 illustrates a flowchart of a method of determining a type of a driver according to an example embodiment.

FIG. 4 illustrates a flowchart of a method 400 of determining a type of a driver 108 according to an example embodiment. Referring to FIGS. 1-4, in some example embodiments, the method 400 includes, at step 402, sending, by the lighting control device 102, one or more queries to the driver 108. At step 404, the method 400 may include determining, by the lighting control device 102, a type of the driver 108 based on one or more results of the one or more queries. At step 406, the method 400 may include sending to the driver 108, by the lighting control device 102, a lighting control command that is compatible with the driver 108 after determining the type of the driver 108. For example, determining the type of the driver 108 may include determining whether the driver 108 is a sensor-ready driver, a DALI driver, or a 0-10v driver.

In some example embodiments, sending the one or more queries to the driver 108 at step 402 includes sending one or more register read commands to the driver 108 to read one or more registers of the driver 108. Sending the one or more queries to the driver 108 at step 402 may also include sending one or more register read commands to the driver 108 multiple times to read one or more registers of the driver 108 multiple times. Determining the type of the driver at step 404 based on the one or more queries may include determining whether results of sending the one or more register read commands multiple times indicate that the driver 108 is an SR driver or a DALI driver. Determining the type of the driver at step 404 may also include determining that the driver 108 is a 0-10v driver if the results of the one or more register read commands do not indicate that the driver 108 is an SR driver or a DALI driver.

In some example embodiments, determining the type of the driver 108 at step 404 may include determining whether the driver 108 is the DALI driver after determining that the driver 108 is not an SR driver. Alternatively, determining the type of the driver 108 at step 404 may include determining whether the driver 108 is an SR driver after determining that the driver 108 is not a DALI driver. Determining the type of the driver 108 at step 404 may also include determining that the driver 108 is a 0-10v driver after determining that the driver is neither an SR driver nor a DALI driver.

In some example embodiments, the method 400 may include other steps before, after, and/or in between the steps 402-406. In some alternative embodiments, some of the steps of the method 400 may be performed in a different order than described above.

Figure 5:
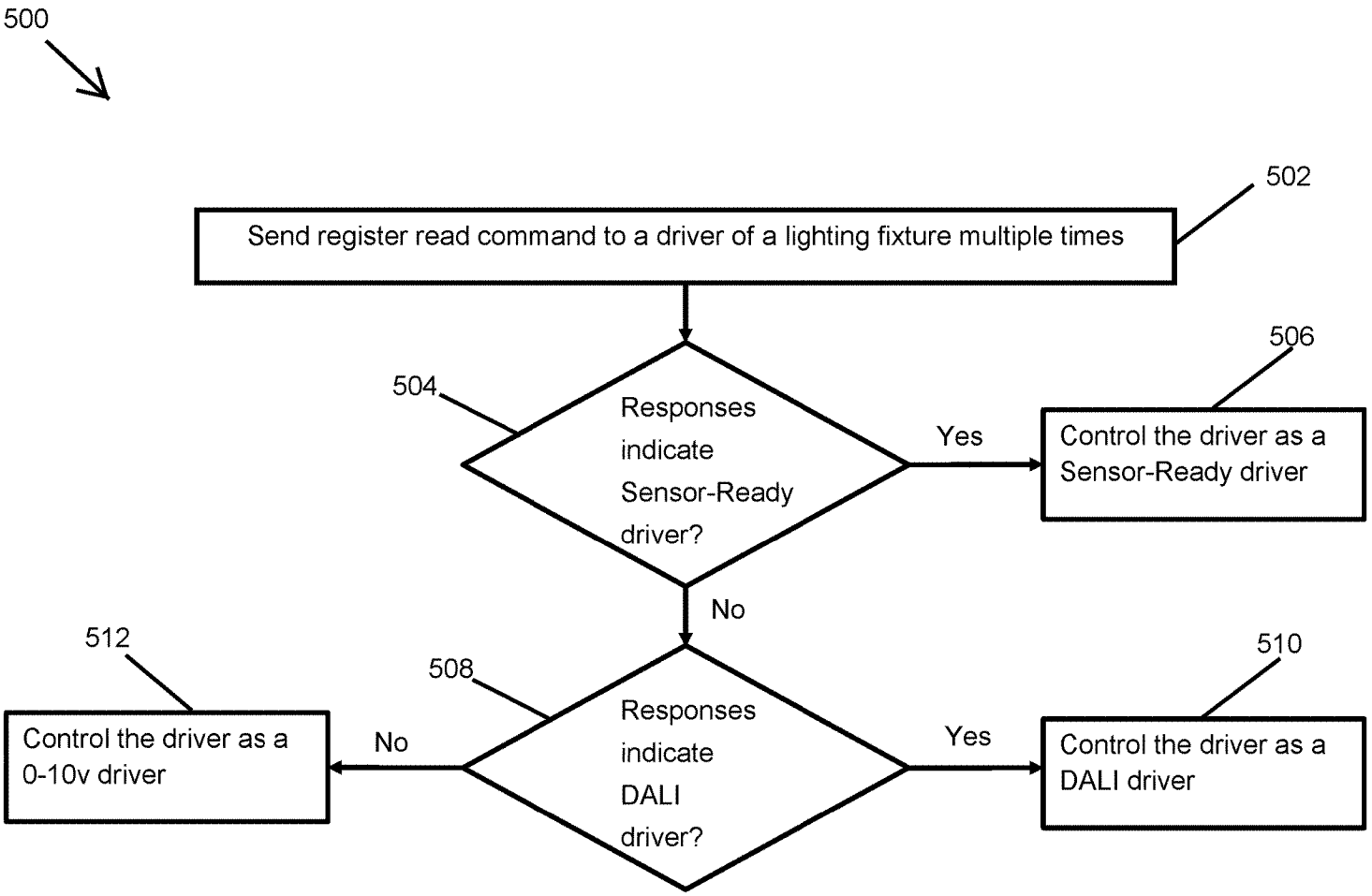
FIG. 5 illustrates a flowchart of a method of determining a type of a driver according to another example embodiment.

FIG. 5 illustrates a flowchart of a method 500 of determining a type of a driver according to another example embodiment. Referring to FIGS. 1-5, in some example embodiments, the method 500 includes, at step 502, sending one or more register read commands to the driver 108 of the lighting fixture 104 multiple times (e.g., 3 times). For example, the lighting control device 102 may send the one or more read commands to the driver 108. At step 504, the method 500 may include determining whether one or more responses that the driver 108 provides in response to the one or more register read commands indicate that the driver 108 is an SR driver. Because the lighting control device 102 may receive multiple responses to the read commands sent multiple times, the lighting control device 102 may implement, for example, a majority-rule process to determine whether the driver 108 is a particular type of driver. If the one or more responses indicate that the driver 108 is an SR driver, the lighting control device 102 may control the driver 108 as an SR driver at step 506. For example, the lighting control device 102 may send to the driver 108 lighting control commands that are compatible with SR drivers. The lighting control device 102 may also receive information from the driver 108 and interpret the received information as originating from an SR driver.

In some example embodiments, if the one or more the responses do not indicate that the driver 108 is an SR driver at step 504, the lighting control device 102 may determine, at step 508, whether the one or more responses indicate that the driver 108 is a DALI driver. If the one or more responses indicate that the driver 108 is a DALI driver at step 508, the lighting control device 102 may control the driver 108 as a DALI driver at step 510. For example, the lighting control device 102 may send to the driver 108 lighting control commands that are compatible with DALI drivers. The lighting control device 102 may also receive information from the driver 108 and interpret the received information as originating from a DALI driver. If the one or more responses do not indicate that the driver 108 is a DALI driver, the lighting control device 102 may control the driver 108 as a 0-10v driver at step 512. For example, the lighting control device 102 may send to the driver 108 lighting control commands that are compatible with 0-10v drivers.

In some example embodiments, the lighting control device 102 may determine that a response that is expected from an SR driver or a DALI driver has not been received by the lighting control device 102 from the driver 108. For example, if the driver 108 is a 0-10v driver, the driver 108 may not respond to the register read commands. In such cases, because the driver 108 is expected to be either an SR driver, a DALI driver, or a 0-10v driver, the lighting control device 102 may determine that the driver 108 is a 0-10v driver. For example, the lighting control device 102 may determine that the driver 108 is a 0-10v driver if the lighting control device 102 does not received responses expected from SR or DALI drivers in response to the majority of register read commands sent to the driver 108 by the lighting control device 102.

In some example embodiments, the method 400 may include other steps before, after, and/or in between the steps 502-512. In some alternative embodiments, some of the steps of the method 500 may be performed in a different order than described above.

Although particular embodiments have been described herein in detail, the descriptions are by way of example. The features of the example embodiments described herein are representative and, in alternative embodiments, certain features, elements, and/or steps may be added or omitted. Additionally, modifications to aspects of the example embodiments described herein may be made by those skilled in the art without departing from the spirit and scope of the following claims, the scope of which are to be accorded the broadest interpretation so as to encompass modifications and equivalent structures.

What is claimed is:

1. A method of controlling different types of lighting fixture drivers, the method comprising:

sending, by a lighting control device, one or more queries to a driver, wherein sending the one or more queries to the driver includes sending one or more register read commands to the driver to read one or more registers of the driver;

determining, by the lighting control device, a type of the driver based on one or more results of the one or more queries; and sending to the driver, by the lighting control device, a lighting control command that is compatible with the driver after determining the type of the driver.

2. The method of claim 1, wherein determining the type of the driver includes determining whether the driver is a sensor-ready driver, a DALI driver, or a 0-10v driver.

3. The method of claim 2, wherein determining the type of the driver includes determining whether the driver is the DALI driver after determining that the driver is not the sensor-ready driver.

4. The method of claim 2, wherein determining the type of the driver includes determining whether the driver is the sensor-ready driver after determining that the driver is not the DALI driver.

5. The method of claim 2, wherein determining the type of the driver includes determining that the driver is the 0-10v driver after determining that the driver is neither the sensor-ready driver nor the DALI driver.

6. The method of claim 2, wherein sending the one or more queries to the driver includes sending the one or more register read commands to the driver multiple times to read the one or more registers of the driver multiple times and wherein determining the type of the driver based on the one or more queries includes determining whether results of sending the one or more register read commands multiple times indicate that the driver is the sensor-ready driver or the DALI driver.

7. The method of claim 6, wherein determining the type of the driver includes determining that the driver is the 0-10v driver if the results of the one or more register read commands do not indicate that the driver is the sensor-ready driver or the DALI driver.

8. The method of claim 1, wherein the lighting control device is a dimmer.

9. The method of claim 1, wherein the lighting control device is a sensor.

10. A lighting control device, comprising:

a driver interface circuit configured to provide a driver control signal to a driver; and a controller configured to:

send one or more queries to the driver via the driver interface circuit by sending one or more register read commands to the driver to read one or more registers of the driver;

determine a type of the driver based on one or more results of the one or more queries; and send a lighting control command to the driver via the driver interface circuit, wherein the driver interface circuit is configured to generate the driver control signal based on the lighting control command, wherein the driver control signal is compatible with the type of the driver.

11. The lighting control device of claim 10, wherein the controller is configured to determine the type of the driver by determining whether the driver is a sensor-ready driver, a DALI driver, or a 0-10v driver.

12. The lighting control device of claim 11, wherein the controller determines whether the driver is the DALI driver after determining that the driver is not the sensor-ready driver.

13. The lighting control device of claim 11, wherein the controller determines whether the driver is the sensor-ready driver after determining that the driver is not the DALI driver.

14. The lighting control device of claim 11, wherein the controller determines that the driver is the 0-10v driver after determining that the driver is neither the sensor-ready driver nor the DALI driver.

15. A lighting system, comprising:

a lighting fixture comprising a light source and a driver that provides power to the light source; and a lighting control device, comprising a controller configured to:

send one or more queries to the driver by sending one or more register read commands to the driver to read one or more registers of the driver;

determine a type of the driver based on one or more results of the one or more queries; and send a driver control signal to the driver, wherein the driver control signal is compatible with the type of the driver.

16. The lighting system of claim 15, wherein the controller is configured to determine the type of the driver by determining whether the driver is a sensor-ready driver, a DALI driver, or a 0-10v driver.

17. The lighting system of claim 15, wherein the controller is configured to send the one or more queries to the driver by sending the one or more register read commands multiple times to the driver to read the one or more registers of the driver multiple times and wherein the controller is configured to determine the type of the driver by determining whether results of sending the one or more register read commands multiple times indicate that the driver is the sensor-ready driver or the DALI driver.

18. The lighting system of claim 17, wherein the controller is configured to determine that the driver is a sensor-ready driver or a DALI driver if the results of the one or more register read commands do not indicate that the driver is the sensor-ready driver or the DALI driver.

* * * * *